US011707656B2

(12) United States Patent
Scott et al.

(10) Patent No.: US 11,707,656 B2
(45) Date of Patent: Jul. 25, 2023

(54) SMART GOLF PUTTER HEADS

(71) Applicants: Philip Andrew Scott, Sanctuary Cove (AU); Fatiha Sahnoune, Sanctuary Cove (AU)

(72) Inventors: Philip Andrew Scott, Sanctuary Cove (AU); Fatiha Sahnoune, Sanctuary Cove (AU)

(73) Assignee: Philip Andrew Scott, Sanctuary Cove (AU)

( * ) Notice: Subject to any disclaimer, the term of this patent is extended or adjusted under 35 U.S.C. 154(b) by 0 days.

(21) Appl. No.: 17/244,829

(22) Filed: Apr. 29, 2021

(65) Prior Publication Data

US 2021/0339098 A1 Nov. 4, 2021

Related U.S. Application Data

(63) and a continuation-in-part of application No. 29/736,548, filed on Jun. 1, 2020.

(60) Provisional application No. 63/017,256, filed on Apr. 29, 2020.

(51) Int. Cl.
*A63B 53/04* (2015.01)
*A63B 53/00* (2015.01)

(52) U.S. Cl.
CPC ..... *A63B 53/0487* (2013.01); *A63B 53/007* (2013.01)

(58) Field of Classification Search
CPC ..... A63B 53/08; A63B 53/06; A63B 2209/14; A63B 53/007; A63B 53/065; A63B 53/0487; A63B 2053/0491
USPC ..... 473/324–350, 287–292, 313; D21/733–736
See application file for complete search history.

(56) References Cited

U.S. PATENT DOCUMENTS

D58,209 S * 6/1921 Bacheller ..... D21/745
2,954,231 A * 9/1960 Macintyre ..... A63B 53/0487 473/251
2,957,696 A * 10/1960 Warpotas ..... A63B 53/007 473/251
3,143,349 A * 8/1964 Macintyre ..... A63B 53/0487 473/338
3,448,981 A * 6/1969 Anweiler ..... A63B 53/007 473/314

(Continued)

*Primary Examiner* — Sebastiano Passaniti
(74) *Attorney, Agent, or Firm* — Pilloff Passino & Cosenza LLP; Sean A. Passino; Rachel K. Pilloff

(57) ABSTRACT

A golf putter clubhead is designed with a unique structure using a geometry and a balance technology to provide super symmetry, harmony and balance at motion and at rest. The clubhead includes a body with triangular members, a putting face, and optional holes. The triangular form clubhead does not require compensation during the swing thus allowing for greater repetition and simplicity of movement in turn producing performance benefits via consistency. The geometric triangular shape of the clubhead provides an instantly recognizable assistance in proper alignment at the rest position. The body of the clubhead may be hollow and feature inner symmetrical structures to complement the form of the body and to enhance and provide superior weight distribution and balance, thus, providing a performance edge in swing consistency and performance, and allowing for repeatability of the clubhead.

13 Claims, 8 Drawing Sheets

(56) References Cited

U.S. PATENT DOCUMENTS 3,459,426 A * 8/1969 Wiley ..... A63B 53/007 473/201
3,815,910 A * 6/1974 Raines ..... A63B 53/007 473/340
D234,962 S * 4/1975 Swash ..... 473/340
3,966,210 A * 6/1976 Rozmus ..... A63B 53/0487 473/341
4,010,958 A * 3/1977 Long ..... A63B 53/0487 473/341
4,712,798 A * 12/1987 Preato ..... A63B 69/3685 473/239
5,082,277 A * 1/1992 Gingold ..... A63B 53/0487 473/250
5,186,465 A * 2/1993 Chorne ..... A63B 60/00 473/350
5,344,151 A * 9/1994 Anderson ..... A63B 60/02 473/337
5,620,379 A * 4/1997 Borys ..... A63B 53/04 473/313
D434,819 S * 12/2000 Hoare ..... D21/736
6,244,974 B1 * 6/2001 Hanberry, Jr. ..... A63B 53/007 473/242
6,267,689 B1 * 7/2001 Ambrose ..... A63B 60/42 473/251
6,695,708 B2 * 2/2004 Fisher ..... A63B 53/007 473/244
6,767,293 B2 * 7/2004 Pechter ..... A63B 53/02 473/313
6,796,911 B2 * 9/2004 Grace ..... A63B 60/02 473/251
6,929,559 B1 * 8/2005 Grace ..... A63B 53/0487 473/251
6,958,019 B2 * 10/2005 Rohrer ..... A63B 60/02 473/251
D543,252 S * 5/2007 Haggstrom ..... D21/736
7,255,653 B2 * 8/2007 Saso ..... A63B 53/0466 473/345
7,347,793 B2 * 3/2008 Davis ..... A63B 60/02 473/305
7,371,184 B2 * 5/2008 Tao ..... A63B 53/0487 473/242
7,491,131 B2 * 2/2009 Vinton ..... A63B 60/02 473/251
7,670,232 B2 * 3/2010 Franklin ..... A63B 60/02 473/251
7,674,186 B2 * 3/2010 Bitko ..... A63B 60/02 473/340
7,753,809 B2 * 7/2010 Cackett ..... A63B 53/0466 473/345
7,854,665 B2 * 12/2010 Dewhurst ..... A63B 53/0466 473/340
7,867,104 B2 * 1/2011 Franklin ..... A63B 53/0487 473/251
8,303,434 B1 * 11/2012 DePaul ..... A63B 53/0487 473/341
8,353,782 B1 * 1/2013 Beach ..... A63B 60/02 473/329
8,900,064 B2 * 12/2014 Franklin ..... A63B 53/0487 473/251
9,433,834 B2 * 9/2016 Stites ..... A63B 53/04
9,604,108 B1 * 3/2017 Dunnell ..... A63B 60/02
2002/0151374 A1 * 10/2002 Imamura ..... A63B 53/0487 473/236
2003/0232661 A1 * 12/2003 Greer, Jr. ..... A63B 53/0487 473/340
2006/0189409 A1 * 8/2006 Krumme ..... A63B 53/047 473/342
2008/0096682 A1 * 4/2008 Fox ..... A63B 53/0487 473/340
2008/0102980 A1 * 5/2008 Richard ..... A63B 53/02 473/340
2008/0248893 A1 * 10/2008 Davis ..... A63B 60/42 473/340
2014/0024473 A1 * 1/2014 Reid ..... A63B 53/007 473/313
2016/0089582 A1 * 3/2016 Schweigert ..... A63B 53/065 473/231
2020/0282274 A1 * 9/2020 Spackman ..... A63B 53/08

* cited by examiner

SMART GOLF PUTTER HEADS

The current application claims a priority to the U.S. Provisional Patent application Ser. No. 63/017,256 filed on Apr. 29, 2020.

FIELD OF THE INVENTION

The present invention generally relates to golf clubs. More specifically, the present invention relates to golf club putter heads that provides super symmetrical balance and energy to help a user reduce and/or eliminate undesired rotation of the club head at any point or plane during the swing, including at motion and at rest.

BACKGROUND OF THE INVENTION

A golf club putter designed to improve performance is in demand. Golfers use putters on the putting greens of golf courses to drive the golf ball toward a designated target to complete the hole and score points.

Some putter designs have been improved to provide better performance, but the conventional design of putters makes doing so difficult. For example, if a putter's head shape or weight distribution is asymmetric, players can have difficulty finding the effective center of the face and driving the ball in their intended direction.

Golf club manufacturers have introduced various putter designs that shift the mass to the sides and back of the putter in an attempt to increase the moment of inertia, reducing twisting while minimizing the undesirable effects of off-center contact between the striking surface and the ball. However, the weight distribution of many currently available clubs leaves them poorly balanced, and many golf club putter head designs include alignment systems that do not effectively allow golfers to quickly assess the orientation of the striking face. Furthermore, current clubs are not well balanced and require significant compensation during the swing to achieve a constant ball flight, a skill that requires constant practice that is not available to most golfers.

Such designs include complex angles, lines, points, and other markings that do not always assist the golfer with alignment. Accordingly, there is a need to develop golf club putters and associated technology to solve this problem.

The present invention is intended to address problems associated with and/or otherwise improve on conventional devices through an innovative smart golf club putter head designed to provide balanced weight distribution for improved performance while incorporating other problem-solving features.

SUMMARY OF THE INVENTION

The present invention provides a clubhead of a golf putter, which is designed with a unique and innovative structure for optimized super symmetry, balance, and alignment using a balance technology. The balance technology used in the present invention incorporates super symmetrical balance and energy between the clubhead and the shaft of a golf club. The resulting clubhead reduces and/or eliminates undesired rotations of the clubhead at any point or plane of a golf swing, including in motion and at rest. The invention provides golf putter heads with perfect geometric balance and harmony both internally and externally. The smart putter head designs and materials will dramatically reduce the need for compensation during use therefore simplifying the input from the golfer and allowing for improvement.

The clubhead of the present invention includes a body that comprises at least one triangular member, a putting face, and optional holes on the body, a hosel and inner technology. The body may be hollow with a cavity to accommodate the inner technology and other features to ensure optimal weight distribution and super symmetry of the club head. The smart clubhead is designed for use in various types of golf clubs, including, but not limited to, drivers, fairway clubs, iron clubs, and hybrid clubs, etc., to provide a balanced weight distribution with an optimized balance for improved golfing performance of the user. Thus, the unique clubhead of the present invention provides a performance edge in terms of golf swing consistency and performance, and allows for repeatability in the action of the putter head.

DETAIL DESCRIPTIONS OF THE INVENTION

Figure 1:
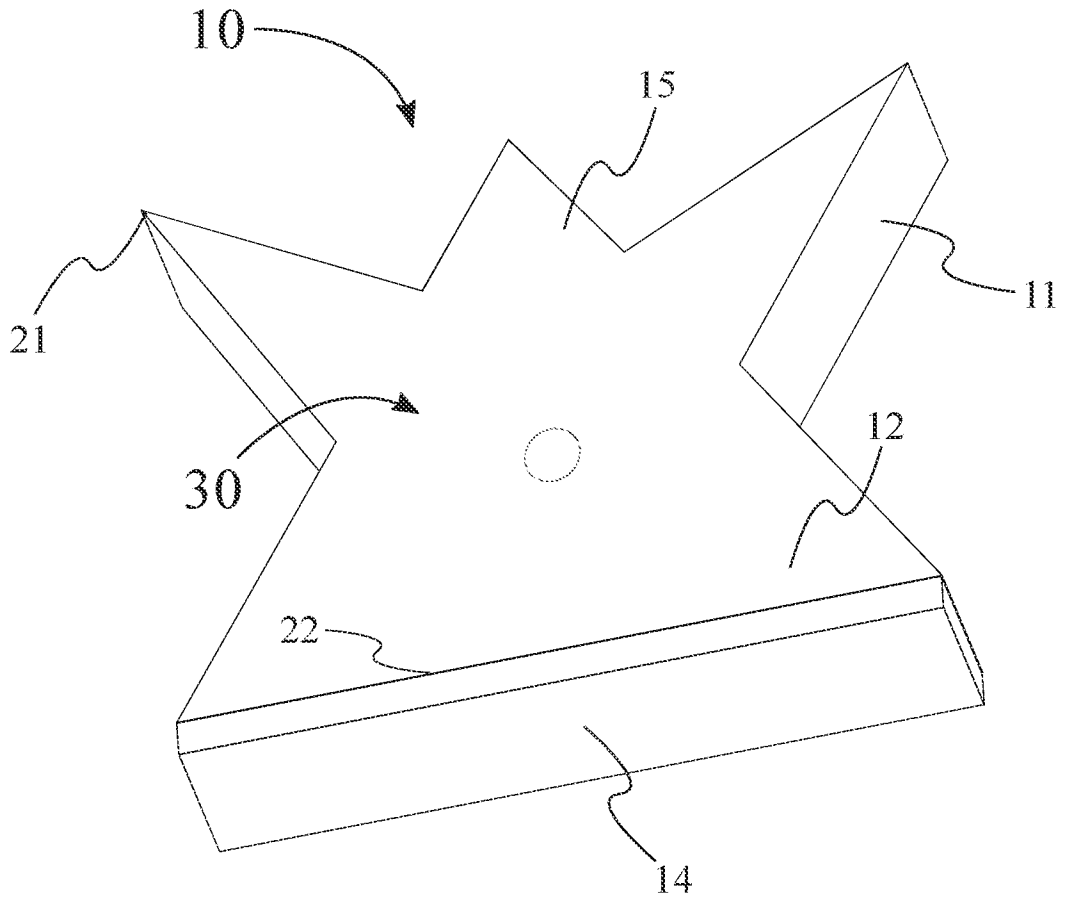
FIG. 1 is a perspective view of one embodiment of the present invention with three triangular members.

All illustrations of the drawings are for the purpose of describing selected versions of the present invention and are not intended to limit the scope of the present invention.

The present invention provides a clubhead of a golf putter, interchangeably with "putter head" of a golf club, which is designed with a unique and innovative structure for optimized super symmetry, balance, and alignment to help a user achieve improved golf swing performance. The putter head of the present invention may be used with an additional internal system that adjusts the weight distribution of the golf club to reduce and/or eliminate undesired rotations of the putter head at any point or plane of a golf swing, including in motion and at rest. Thus, the putter head provide a performance edge in terms of consistency and performance and allows for repeatability in the action of the putter head.

As can be seen in FIG. 1 to FIG. 7, the clubhead of a putter of the present invention comprises a body 10, a hosel 30, and a shaft 50, to provide a super symmetrical balance of the clubhead for improved golfing performance. The body 10 of the clubhead is connected to the shaft 50 of a golf club through the hosel 30. More specifically, the body 10 comprises a symmetrical geometry, which may at any point be smoothed to produce a smoother edge without losing its inherent triangular shape. Additionally, the body 10 comprises at least one triangular member 11, a crown 12, a sole 13, a putting face 14, and an aft end 15. One or more of the triangular members can be connected to form the putter device of the present invention to provide a balanced weight distribution with an optimized super symmetry, balance, and alignment to achieve a super symmetrical balance of the clubhead for improved golfing performance. The putter head may include one or more hollow areas inside the clubhead. The overall design of the putter clubhead in terms of both outer and inner structure will provide an acoustic benefit to the putting face when making contact with the golf ball in that the strike moment will provide a resulting improved feel as a feedback loop. The design of the putter clubhead can be devised according to specific principles of science in general and physics in particular, thus this design may include principles of the Golden Ratio. The clubhead can be made of any suitable material, including, but not limited to, thermoplastics as well as shape-memory metals (e.g., steel, titanium, and aluminum), copper, nickel, alloys of various materials, graphite, and treatments of these materials that may be deemed to assist performance or presentation. Alternatively, the clubhead may be made of a combination of one or more such materials. The materials may be in powder, liquid, foam, or solid-state form. The applications of these materials can include, but are not limited to, stripes, rings, and emulsion, etc.

Figure 2:
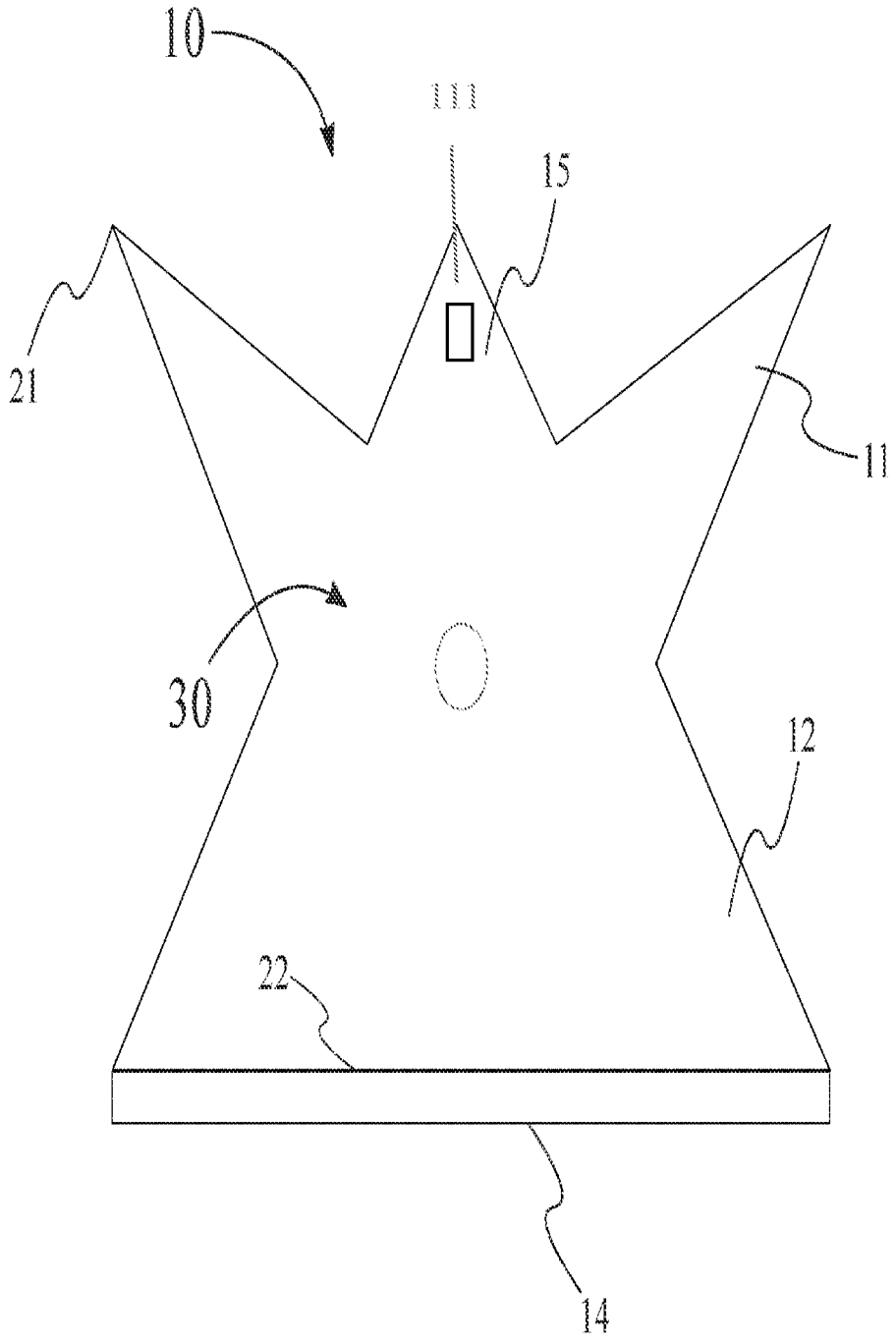
FIG. 2 is a top view of the embodiment of the present invention with three triangular members.
Figure 3:
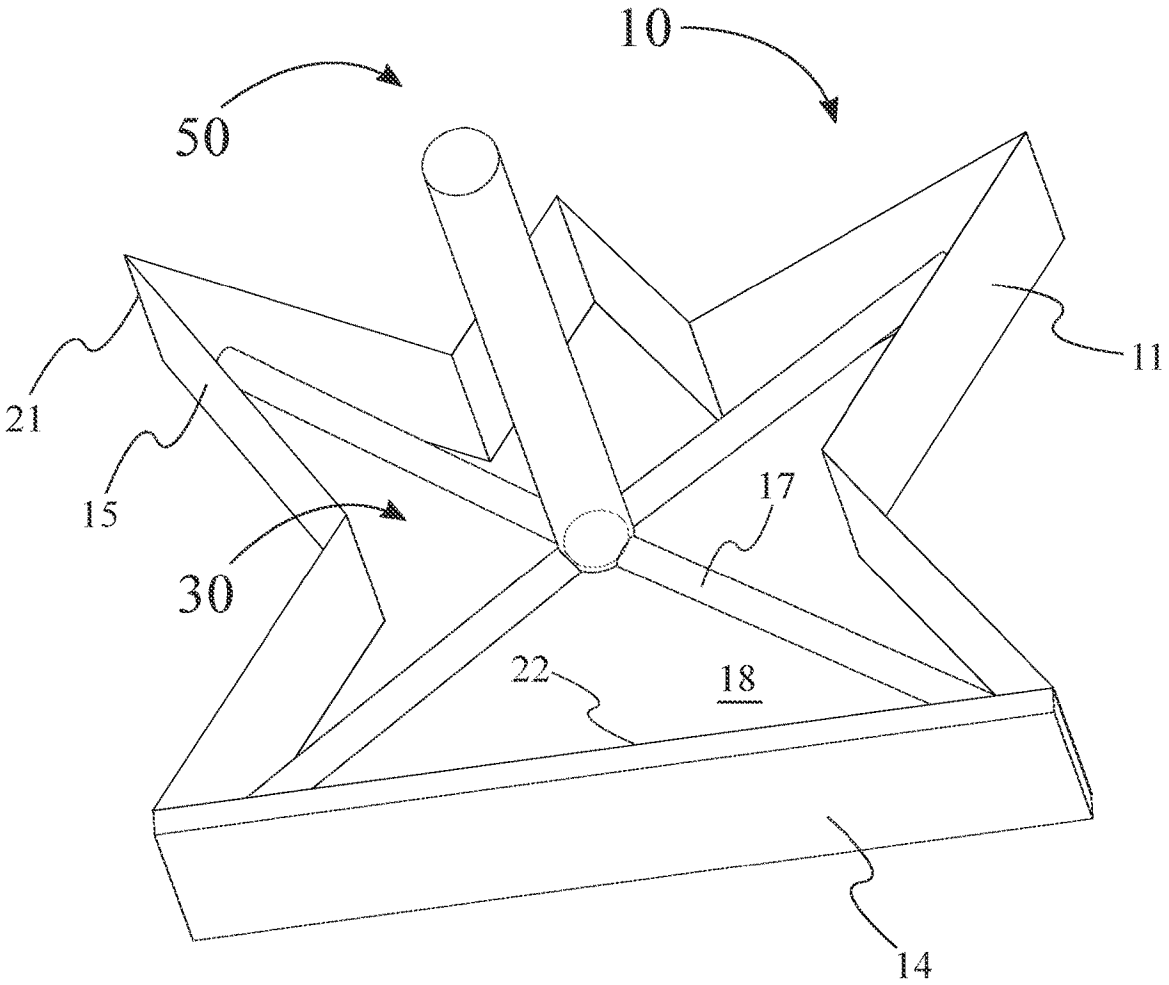
FIG. 3 is perspective view of the embodiment of the present invention with three triangular members, wherein the interior of a hollow body of the present invention includes two trunks with a hosel on the center.
Figure 4:
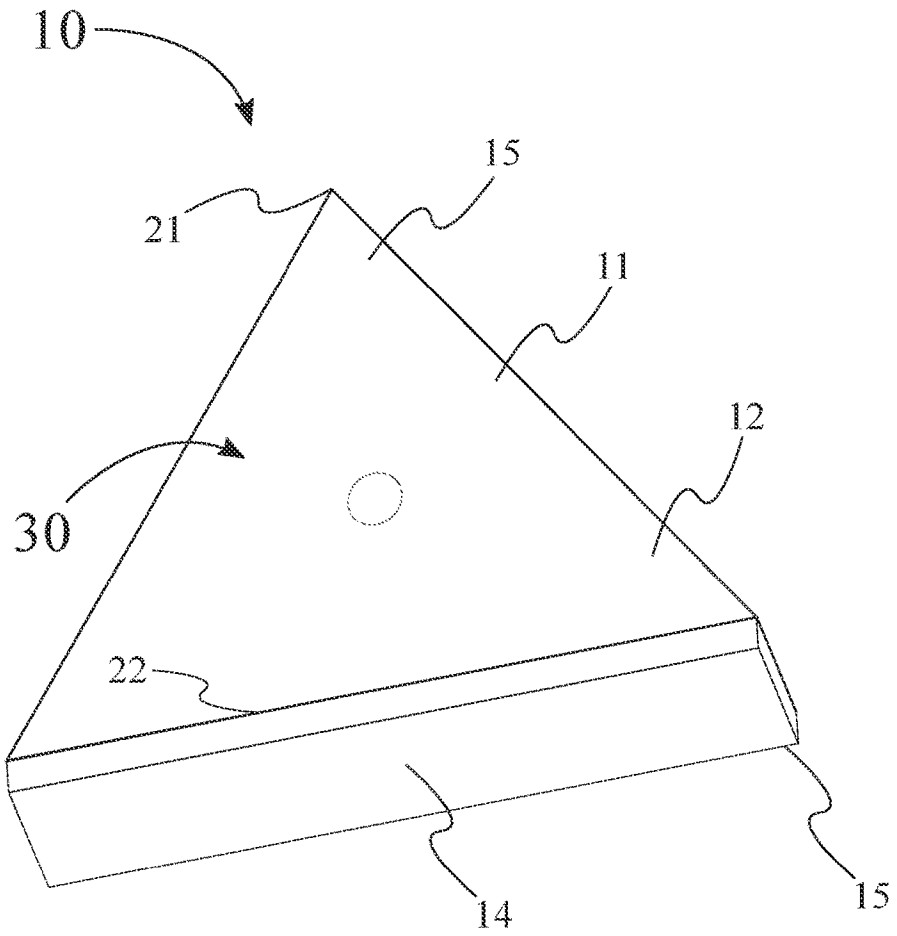
FIG. 4 is a perspective view of an alternative embodiment of the present invention with one triangular member.
Figure 5:
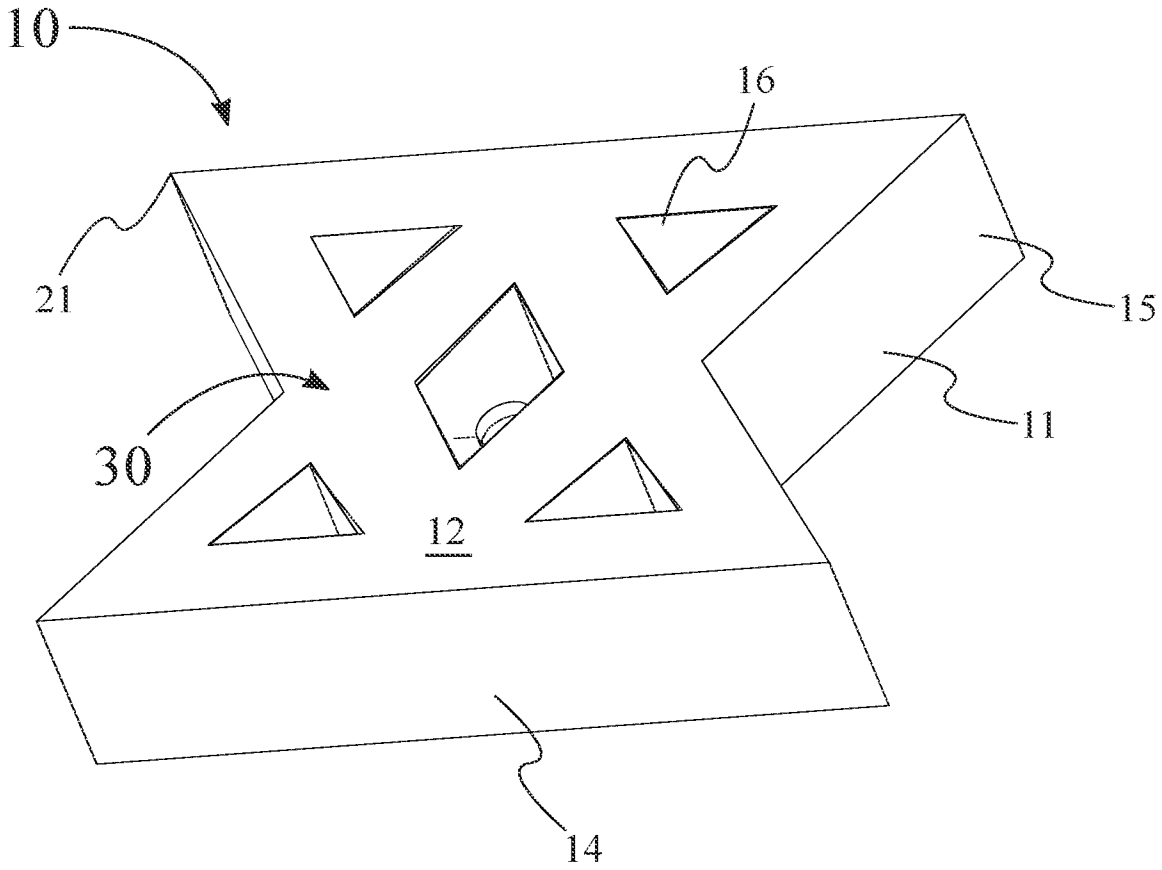
FIG. 5 is a perspective view of another embodiment of the present invention with two hourglass-shaped bodies that each comprises two triangular members.
Figure 6:
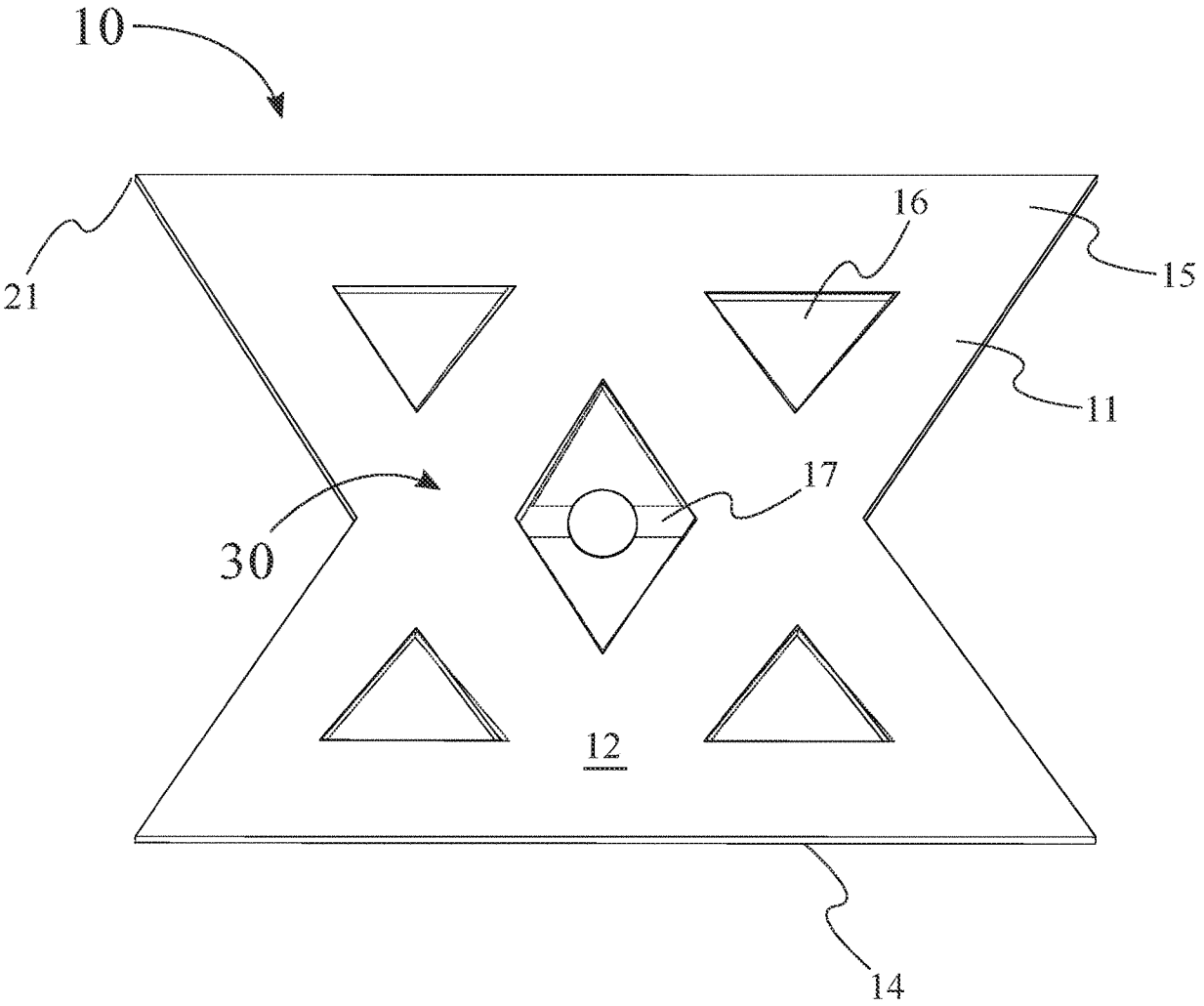
FIG. 6 is a top view of the embodiment of the present invention with two hourglass-shaped bodies that each comprises two triangular members.

As can be seen in FIG. 1 to FIG. 7, the at least one triangular member 11 comprises an apex 21 and a base 22. The base 22 is attached to the putting face 14 of the body 10, while the apex 21 is terminally positioned on the at least one triangular member 11 opposite the base 22. The aft end 15 is positioned on the body 10 opposite the putting face 14, and the aft end 15 comprises at least one predetermined balance weight 111, which is used to achieve the optimized MOI and alignment. The at least one triangular member 11 may comprise a substantially triangular shape, and/or may comprise an equilateral triangle. In some embodiments, two equilateral triangular members can be combined to form a clubhead in a way that the apex 21 of each of the at least one triangular member 11 is attached and integrated into the inner walls of the putter clubhead at both the putting face 14 and the aft end 15 (which can be the base of one equilateral triangular member combined with the other equilateral triangular member, having one side as the putting face 14). When viewed from the top, the shape of the at least one triangular member 11 is substantially triangular with or without rounded corners, as can be seen in FIG. 1 to FIG. 7. Additionally, the at least one triangular member 11 may include a substantially triangular shape from the putting face 14 to the aft end 15, with the putting face 14 forming the base 22 of the triangle and the rearmost point forming the apex 21 of the triangle. The at least one triangular member 11 may include sides set perpendicular to the surface of the sole 13 and/or the surface of the crown 12. In some embodiments, the at least one triangular member 11 may further include a tapered or smoothed side going from the crown 12 toward the sole 13 of the at least one triangular member 11. In another embodiment, the at least one triangular member 11 may comprise one triangular member, as can be seen in FIG. 4. The base 22 of the one triangular member 11 in this embodiment coincides with the putting face 14, while the apex 21 is terminally positioned on the aft end 15, opposite the putting face 14. The at least one triangular member 11 can be of any suitable size. In some embodiments, the dimensions of the at least one triangular member 11 may meet all size limits required by the United States Golf Association (USGA).

As can be seen in FIG. 1 to FIG. 2, and FIG. 4 to FIG. 6, the crown 12 of the body 10 is terminally positioned on the body 10 facing a user during a golf swing. The crown 12 (the top surface) can be of any suitable shape when viewed from the front or back of the at least one triangular member 11. The sole 13 is terminally positioned on the body 10 opposite the crown 12. Additionally, the sole 13 can be substantially flat or parallel to the ground surface. In some embodiments, the sole 13 may include a consistent curve emanating from all axis points of the clubhead and culminating in a raised section at the point established as the center of mass on the sole 13 of the clubhead. Both the sole 13 and the crown 12 may each extend away from the putting face 14 to the aft end 15. Additionally, the body 10 may comprise at least one hole 16 which traverses the body 10 from the crown 12 to the sole 13. The at least one hole 16 can be of any suitable shape, including, but not limited to, triangular, rectangular, circular, or diamond-shaped, etc. Further, the hosel 30 may be separate from the present invention, or may be positioned on the crown 12, as can be seen in FIG. 3. The hosel 30 can be positioned in any suitable location to improve positioning of the CG and balance of the clubhead to provide a super symmetrical balance of the clubhead for improved golfing performance.

Figure 7:
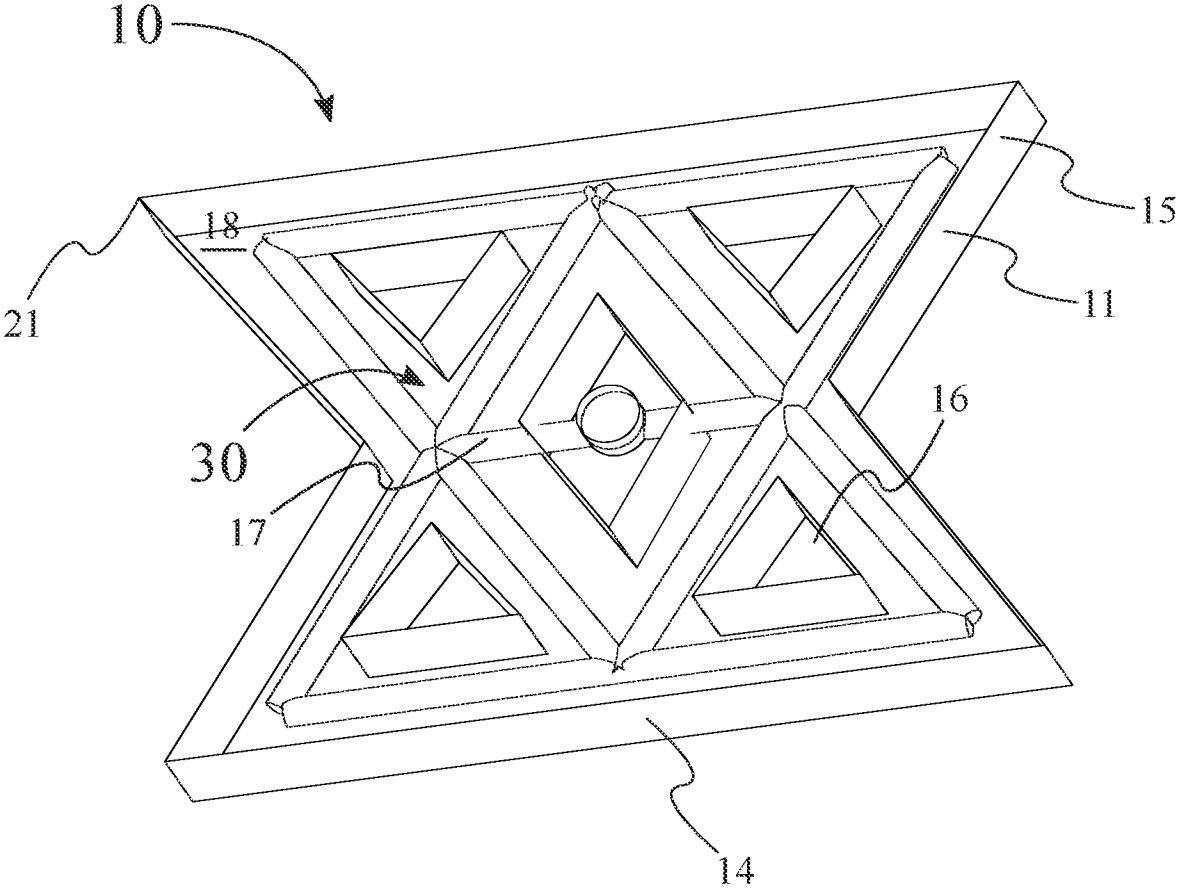
FIG. 7 is a perspective view of another embodiment of the present invention with two hourglass-shaped bodies, wherein the interior of the present invention comprises triangular members.
Figure 8:
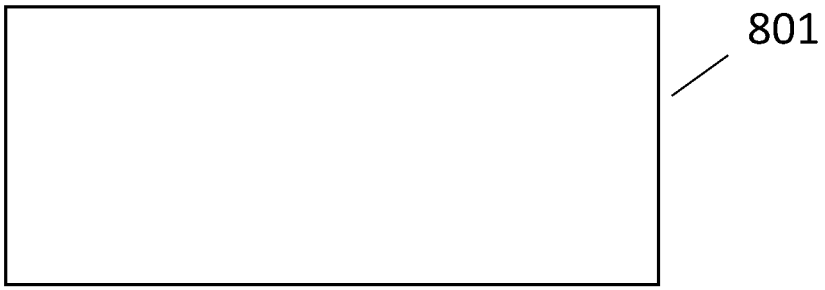
FIG. 8 shows an insert embodiment.

As can be seen in FIG. 3 and FIG. 7, in some embodiments of the present invention, the body 10 may comprise a cavity 18, which is interiorly positioned on the body 10. Additionally, the cavity 18 may comprise at least one inner core fill material, including, but not limited to, thermoplastic, shape-memory material, Nitinol, Aerogel, and other shape-memory polymers including Sorbothane, etc. Additionally, the thickness of the walls of the outer shell of the body 10 can be comparable throughout the clubhead, and the clubhead can be supersymmetric at the central point of the clubhead when applied to any plane, including, but not limited to, linear and rotational symmetry. Further, the cavity 18 may comprise an inner structure which may include, but is not limited to, a symmetrical geometry, any geometric pattern that creates a harmonic balance, whereby the resonance of the clubhead can match the properties of the shaft 50 that can be attached to the body 10 of the clubhead. As can be seen in FIG. 3 and FIG. 7, as some other embodiments, the cavity 18 may comprise at least one trunk 17 and a hosel 30. The at least one trunk 17 is interiorly positioned in the cavity 18 and the hosel 30 is positioned on the at least one trunk 17.

As can be seen in FIG. 3, a plurality of trunks is located on the base and each of the plurality of trunks extends radially outward from a hosel located substantially centrally within the cavity such that a first end of each of the plurality of trunks is in communication with the hosel and an opposed second end of each of the plurality of trunks abuts an inner surface of the body. The opposed second end of at least one of the plurality of trunks abuts the inner surface of the body at the apex of the at least one triangular member. Also, the opposed second end of at least one of the plurality of trunks abuts an inner surface of the putting face. As also shown in FIG. 3, the opposed second end of at least one of the plurality of trunks abuts an inner surface of the putting face at a first end thereof, and the opposed second end of another of the plurality of trunks abuts an inner surface of the putting face at an opposed second end thereof.

As can be seen in FIG. 1 to FIG. 3, in some embodiments, the at least one triangular member 11 may comprise two or more triangular members connected together with the putting face 14 on one side of one of these triangular members, and each of the two or more triangular members comprising a base 22 and an apex 21. The base 22 of each of the two or more triangular members is attached to the putting face 14 and the apex 21 of each of the two or more triangular members is terminally positioned on the aft end 15 opposite the putting face 14 to provide a super symmetrical balance of the clubhead for improved golfing performance. As can be seen in FIG. 4 to FIG. 3, in other embodiments, the at least one triangular member 11 comprises a plurality of triangular members, and the plurality of triangular members may be formed into a trapezoidal shape. Additionally, the trapezoidal shape may include, but is not limited to, an hourglass shape.

In some embodiments of the present invention, the at least one triangular member 11 may include a recessed portion, or an insert 801 filled with striking-surface material (not illustrated) to form the putting face 14. The insert 801 may be designed so as to feature a surface resembling or made of Sharklet for the purpose of dispersion and removal of any foreign matter or bacteria that may adhere or apply to the insert 801. This insert design could be at a nano or Planck scale. The insert 801 is interiorly positioned on the putter face 14. The insert 801 may comprise a material including, but not limited to, a smart material, a shape-memory material, a thermoplastic material to improve putting performance by means of improved deformation and reformation of the insert 801. The putting face 14 can be of any suitable shape including a substantially rectangular shape. The striking surface material may be metal, or natural or synthetic polymer as discussed in more detail herein. The striking surface material will lie flush with the balance of the putter face 14.

In some embodiments, the clubhead may include one or more straight lines as an integral part of the body 10 to assist in the alignment of the putter relative to the direction of travel of the putter clubhead in the ball-striking motion during golf swings.

Although the invention has been explained in relation to its preferred embodiment, it is to be understood that many other possible modifications and variations can be made without departing from the spirit and scope of the invention as hereinafter claimed.

What is claimed is:

1. A clubhead for providing balance and energy to golf putters comprising:

a body;

the body comprising a symmetrical geometry;

the body comprising at least one triangular member, a crown, a sole, a putting face, and an aft end;

the at least one triangular member comprising an apex and a base;

the base being attached to the putting face of the body;

the apex being terminally positioned on the at least one triangular member opposite the base;

the aft end being positioned on the body opposite the putting face; and the aft end comprising at least one predetermined balance weight, wherein the at least one triangular member is an equilateral triangle;

wherein the body comprises a cavity interiorly positioned on the body;

wherein a plurality of trunks is located on the base and each of the plurality of trunks extends radially outward from a hosel located substantially centrally within the cavity such that a first end of each of the plurality of trunks is in communication with the hosel and an opposed second end of each of the plurality of trunks abuts an inner surface of the body; and wherein the opposed second end of at least one of the plurality of trunks abuts an inner surface of the putting face at a first end thereof, and the opposed second end of another of the plurality of trunks abuts an inner surface of the putting face at an opposed second end thereof.

2. The clubhead as claimed in claim 1, wherein the cavity comprises at least one inner core fill material.

3. The clubhead as claimed in claim 2, wherein the at least one inner core material is a thermoplastic.

4. The clubhead as claimed in claim 2, wherein the at least one inner core material is a shape-memory material.

5. The clubhead as claimed in claim 2 comprising:

the cavity comprising an inner structure; and the inner structure comprising a symmetrical geometry.

6. The clubhead as claimed in claim 1 comprising:

the at least one triangular member comprising two or more triangular members;

each of the two or more triangular members comprising a base and an apex;

the base of each of the two or more triangular members being attached to the putting face; and the apex of each of the two or more triangular members being terminally positioned on the aft end opposite the putting face.

7. The clubhead as claimed in claim 1 comprising:

the at least one triangular member comprising a plurality of triangular members; and the plurality of triangular members being formed into a trapezoidal shape.

8. The clubhead as claimed in claim 1 comprising:

the putting face comprising an insert; and the insert being interiorly positioned on the putting face.

9. The clubhead as claimed in claim 8, wherein the insert comprising a smart material.

10. The clubhead as claimed in claim 8, wherein the insert comprising a shape-memory material.

11. The clubhead as claimed in claim 8, wherein the insert comprising a thermoplastic material.

12. The clubhead as claimed in claim 1, wherein the opposed second end of at least one of the plurality of trunks abuts the inner surface of the body at the apex of the at least one triangular member.

13. The clubhead as claimed in claim 1, wherein the opposed second end of at least one of the plurality of trunks abuts an inner surface of the putting face.

* * * * *